US012084954B1

(12) United States Patent
Allahar

(10) Patent No.: US 12,084,954 B1
(45) Date of Patent: Sep. 10, 2024

(54) DOWNHOLE RESERVOIR STIMULATING SYSTEM AND METHODS

(71) Applicant: Ian A Allahar, College Station, TX (US)

(72) Inventor: Ian A Allahar, College Station, TX (US)

( * ) Notice: Subject to any disclaimer, the term of this patent is extended or adjusted under 35 U.S.C. 154(b) by 0 days.

(21) Appl. No.: 18/243,975

(22) Filed: Sep. 8, 2023

Related U.S. Application Data

(60) Provisional application No. 63/469,493, filed on May 29, 2023.

(51) Int. Cl.
*E21B 43/26* (2006.01)

(52) U.S. Cl.
CPC ..... *E21B 43/26* (2013.01)

(58) Field of Classification Search
CPC ..... E21B 43/26; E21B 7/24; E21B 28/00
See application file for complete search history.

(56) References Cited

U.S. PATENT DOCUMENTS 3,539,025 A * 11/1970 Downen ..... E21B 31/113 175/297
5,782,302 A * 7/1998 Ringgenberg ..... E21B 43/26 166/305.1
7,191,852 B2 * 3/2007 Clayton ..... E21B 7/24 175/55
8,201,641 B2 * 6/2012 Allahar ..... E21B 7/24 175/56
9,010,442 B2 * 4/2015 Streich ..... E21B 34/10 166/376
10,724,323 B2 * 7/2020 Roseman ..... E21B 21/103
10,989,004 B2 * 4/2021 Russell ..... E21B 28/00
2020/0088003 A1 * 3/2020 Wardley ..... E21B 23/0411

FOREIGN PATENT DOCUMENTS

RU 2637350 C1 * 12/2017 ..... E21B 21/10
SU 1633087 A1 * 6/1988

* cited by examiner

*Primary Examiner* — Aaron L Lembo

(57) ABSTRACT

A downhole hydraulic fracking system comprising of a downhole reservoir stimulating tool, an injector tool, and a compression tool, configured to convert compressional strain energy gained from the compression of the drilling tubulars above the tool into multiple high-pressure fluid pressure waves, that then propagates down the drill string and into the subsurface formation causing artificial cracks and fractures; resulting in enhanced rock permeability and increased production of fluids from the sub-surface formation.

7 Claims, 6 Drawing Sheets

DRAWINGS FOR DOWNHOLE RESERVOIR STIMULATION SYSTEM.

DOWNHOLE RESERVOIR STIMULATING SYSTEM AND METHODS

BACKGROUND

1. Field of the Disclosure

Embodiments disclosed herein, relate generally to apparatus and methods for creating and or stimulating fractures within a sub-surface formation utilizing tools located in the wellbore that are capable of generating high-pressure fluid pressure waves.

Specifically, the present disclosure relates to a mechanical downhole hydraulic system comprising, a downhole reservoir stimulating tool, an injector tool, and a compression tool, configured to generate multiple high-pressure fluid pressure waves, utilizing compressional strain energy gained from the compression of the drill string above the tool.

2. Background Art

Hydraulic fracturing or "fracking" is a practice that has been used for decades to stimulate hydrocarbon production from conventional oil and gas reservoirs; and heat flow from geothermal reservoirs. Hydraulic fracturing practices, as known to one familiar in the art, involve injecting a "frack fluid", consisting of water, sand (proppant), and other chemicals, at very high pressures into a subsurface formation.

The high-pressure frack fluid creates a pressure wave that propagates through the rock, causing it to crack the rock and create fractures. Fracturing results in increased permeability and enhances the production of hydrocarbons or geothermally heated fluids from the subsurface formation.

Hydraulic fracturing practices typically require fracture fluid to be pumped into the wellbore at very high pressure. This pumping is typically performed by large diesel-powered pumps. Such pumps can pump fracturing fluid into a wellbore at a high enough pressure to crack the formation.

Recent studies have demonstrated that current fracking practices may be inefficient and continue to have a significant negative environmental impact. There are also significant environmental concerns resulting from fracking such as; the high consumption of fresh water (more than 21 million gallons of freshwater water and chemicals are used in the fracking process), the large volumes of toxic flow back and produced water (chemically complex, and potentially toxic) returned to the surface and the excessive volumes of $CO_2$ generated yearly in fracking operations (approximately 35 million tons of $CO_2$).

Accordingly, there exists a need for methods and apparatuses to overcome the problems associated with current hydraulic fracking practices comprising of pumping high-pressure fluid into a wellbore from the surface utilizing large diesel-powered pumps.

SUMMARY OF THE DISCLOSURE

In one aspect, embodiments of the present disclosure relate to a downhole reservoir stimulating tool comprising of an outer housing, an inner mandrel disposed within the outer housing and configured to move parallel relative to the outer housing, a plurality of seals, and an electromagnetic flowmeter configured with a specialized fluid to restrict the motion of the inner mandrel.

Restricting the downward motion of the inner mandrel results in the compressing of drill string tubulars above the tool, resulting in the development of compressional strain energy in the drill string.

Upon release of the inner mandrel, this compressional strain energy is converted into a high-pressure fluid pressure wave that propagates down the drill string and subsequently propagates into the subsurface formation causing artificial cracks and fractures, thus enhancing the permeability and production of fluids from the sub-surface formation.

In another aspect, embodiments of the present disclosure relate to a downhole reservoir stimulating system comprising a drill string, a downhole reservoir stimulating tool, a compression tool, an injector tool, and other drilling tools, such as packers, as known to one familiar with the art of hydraulic fracking, capable of fracturing a subsurface formation, thus enhancing the permeability and production of fluids from the sub-surface formation.

In another aspect, embodiments of the present disclosure relate to a method for creating and or stimulating fractures within a sub-surface formation utilizing tools, located in the wellbore that are capable of generating high-pressure fluid pressure waves.

Other aspects and advantages of the invention will be apparent from the following description and the appended claims.

DETAILED DESCRIPTION

In one aspect, the present disclosure relates to a downhole reservoir stimulating system comprising of a downhole reservoir stimulating tool, a compression tool, an injector tool, and other tools, such as packers, as known to one familiar with the art of hydraulic fracking coupled to a drill string as known to one familiar with the art of drilling wellbores, configured to create a high-pressure fluid pressure wave using the compressional strain energy gained through the compression of drill string tubulars located above the downhole reservoir stimulating tool in the wellbore.

During operation, the downhole tool is configured to temporarily restrict the inner mandrel from moving down relative to the outer housing mandrel, resulting in an accumulation of compressional strain energy derived from the compression of the drill string tubulars above the tool. Compression of the drill string tubulars above the downhole reservoir stimulating tool is accomplished by stacking weight above the tool, as known by one familiar in the art of drilling.

Upon release, the inner mandrel travels downward at high velocities, converting the compressional strain energy developed in the drill string tubulars, into a high-pressure fluid wave that propagates down the drill string to an injector tool that enhances and diverts the high-pressure fluid wave into the subsurface formation, creating artificial fractures thus enhancing the permeability of the subsurface formation.

Figure 1:
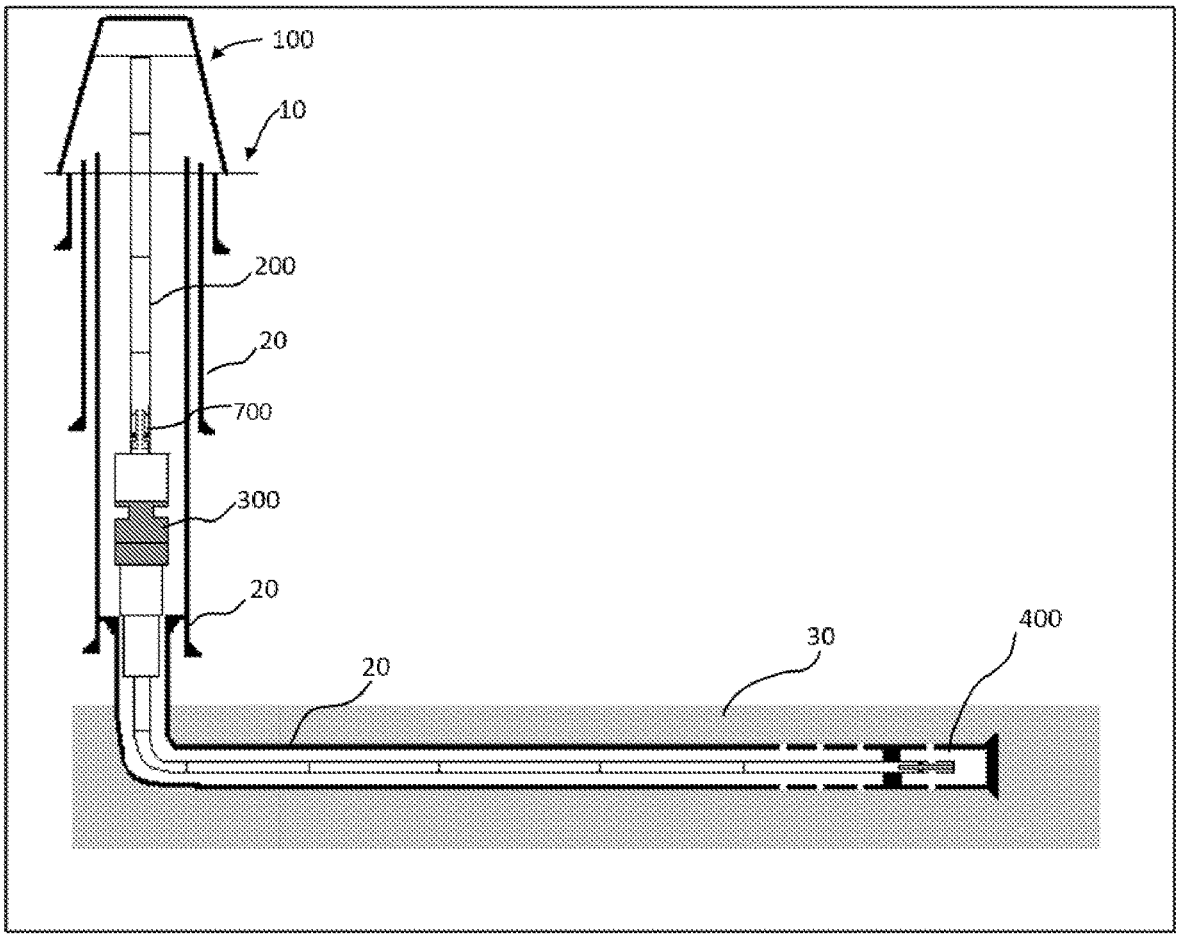
FIG. 1 shows a downhole reservoir stimulating system by embodiments of the present disclosure.

Referring now to FIG. 1, a downhole reservoir stimulating system 100 by embodiments of the present disclosure is shown. The downhole reservoir stimulating system 100 includes a drill string 200, a downhole reservoir stimulating tool 300, a compression tube 700, and an injector tool 400. The drilling system 100 is configured, as known to one familiar with the art of drilling, to be deployed into a cased wellbore 20 and activated to create a high-pressure fluid wave that is propagated through the drill string 200 below the downhole reservoir stimulating tool 300 and to the injector tool 400 located below a surface of the wellbore 10. One of ordinary skills in the art will appreciate that the downhole reservoir stimulating system 100 may include other tools, such as locking sleeves, expandable packers, one-way check valves, pressure seals, etc.

The drill string 200 is coupled to the compression tool 700, the downhole reservoir stimulating tool 300, and the injector tool 400. As known to one skilled in the art, the compression tube 700, the downhole reservoir stimulating tool 300, and the injector tool 400 may be coupled to the drill string 200 through the use of threads, bolts, welds, or any other attachment feature known in the art. Further, the drill string 200 is configured to transfer a drilling fluid downhole to the compression tool 700, the downhole reservoir stimulating tool 300, and the injector tool 400. For example, the drill string 200 may include at least one drill pipe (not shown) having a bore (not shown) that allows the drilling fluid to pass through the drill string 200.

Figure 5:
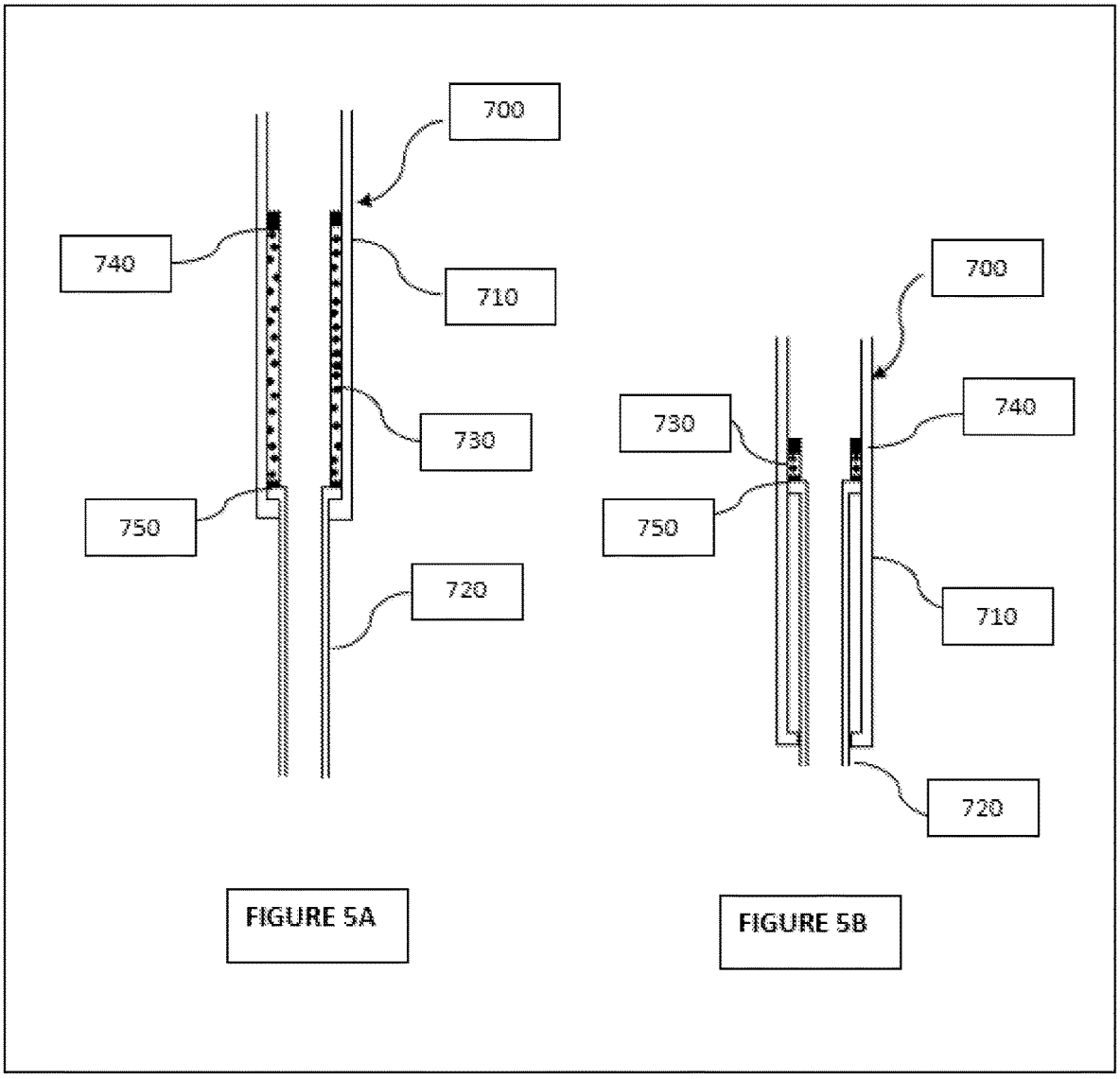
FIG. 5A shows a cross-sectional view of a compression tube in the open position, a component of the downhole reservoir stimulating system by embodiments of the present disclosure.
FIG. 5B shows a cross-sectional view of a compression tube in the closed position, a component of the downhole reservoir stimulating system by embodiments of the present disclosure.

In this embodiment, the compression tool 700, referring to FIG. 5, is configured to distend when in tension referring to FIG. 5A, and closed when in compression referring to FIG. 5B. The compression tool 700, comprises an outer mandrel 710, and an inner mandrel 720, coupled together by a compression tube 730 which can be partially filled with an incompressible fluid, a spring, a compressive fluid, or a combination of these. The fixed upper seal 740 and floating lower seal 750 control the extent to which the inner mandrel 720 and outer mandrel 710 can move relative to each other.

In this embodiment, the injector tool 400 is configured to manage and direct the high-pressure fluid wave into the subsurface reservoir formation 30 located at the bottom of the cased wellbore 20, subsequently causing the subsurface formation 30 to fracture. In one embodiment, the injector tool 400 may include specialized nozzles 420 configured into apertures on the outer wall of the injector tool 400, a specialized check valve 450, and a sealed bottom cap 430 to stop fluid from going through the injector tool 400.

Figure 2A:
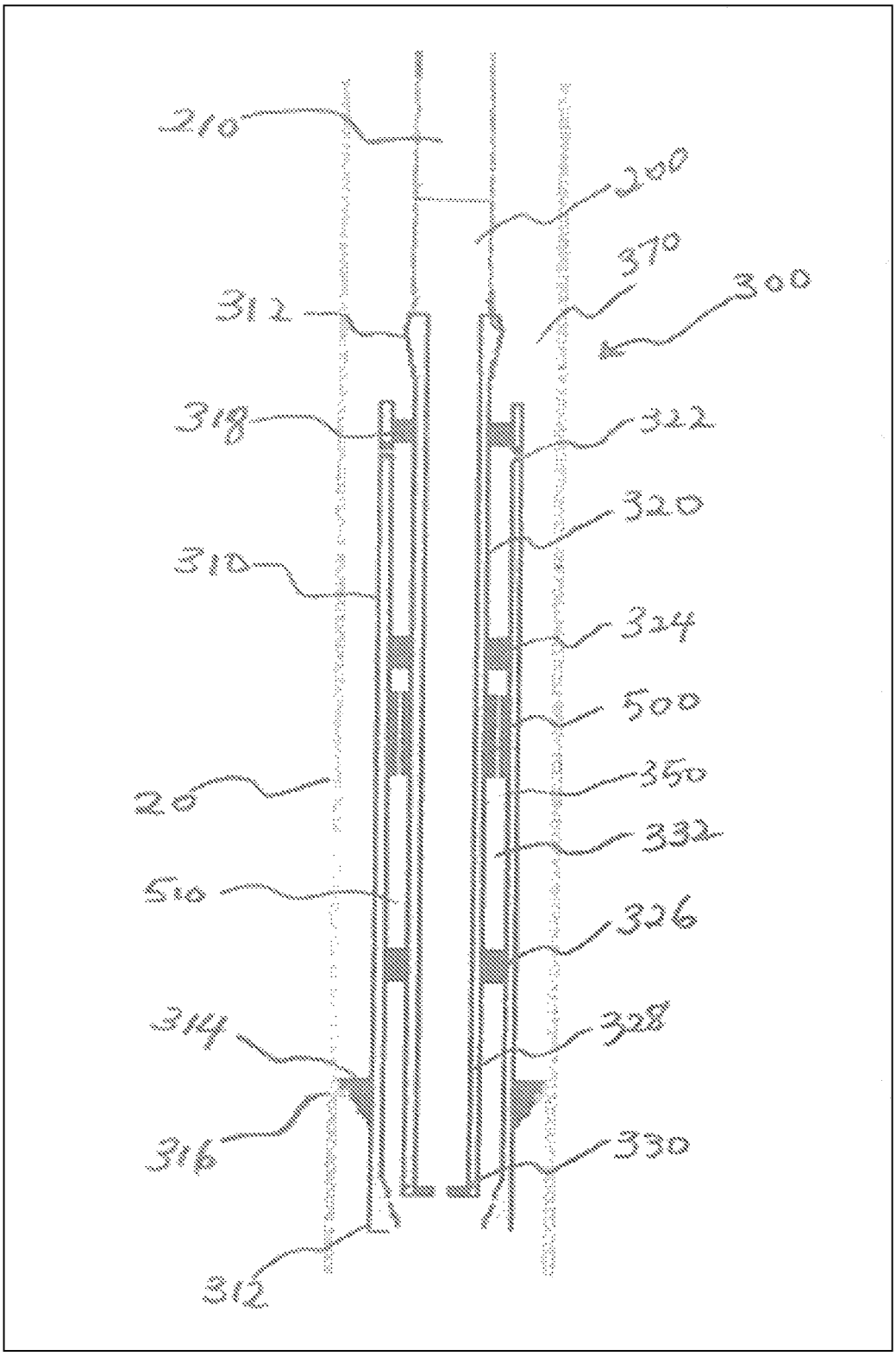
FIG. 2A shows a cross-sectional view of a downhole reservoir stimulating tool in a closed position, a component of the downhole reservoir stimulating system by embodiments of the present disclosure.
Figure 4:
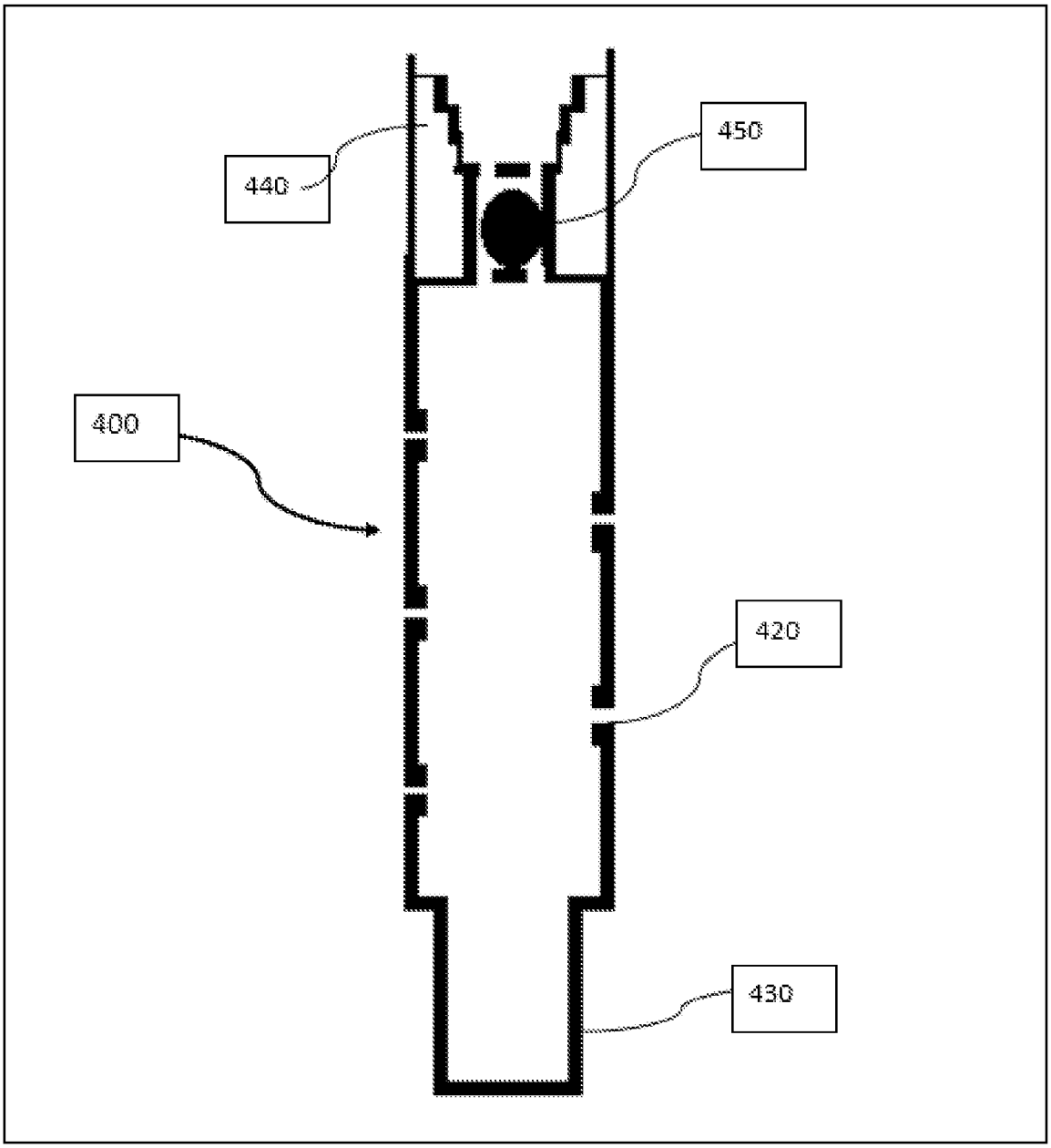
FIG. 4 shows a cross-sectional view of an injector tool, a component of the downhole reservoir stimulating system by embodiments of the present disclosure.

Referring now to FIG. 2A, a cross-sectional view of the downhole reservoir stimulating tool 300 is shown by embodiments of the present disclosure. The downhole reservoir stimulating tool 300 includes an outer housing 310 with connections 312, which allows the downhole reservoir stimulating tool 300 to be coupled to the drill string 200 (FIG. 1) and/or the injector tool 400 (FIG. 4). The outer housing mandrel 310 is outfitted with a locking mechanism 314, which is configured to latch to a locking ring 316 that is configured on the casing string 20. Further, the downhole reservoir stimulating tool 300 includes an inner mandrel 320, a stationary top seal 318, refill ports 322, a fluid chamber 332 housing an electromagnetic flowmeter 500, a lower traveling seal 326, an upper traveling seal 324, a one-way flow control device 330 and an inner mandrel piston 328.

The electromagnetic flowmeter 500, is coupled to the inner surface 350 of the outer housing 310. One skilled in the art will understand the appropriate locations for the upper traveling seal 324, the lower traveling seal 326, and the electromagnetic flowmeter 500. As shown, the electromagnetic flowmeter 500 is disposed between the inner mandrel 320 and the outer housing 310. The upper traveling seal 324 and the lower traveling seal 326 are configured to allow the inner mandrel 320 to move independently from the outer housing 310. The electromagnetic flowmeter 500 is configured to remain stationary relative to the movement of the inner mandrel 320.

Both the inner mandrel 320 and the fluid chamber 332 containing the electromagnetic flowmeter 500 are disposed within the outer housing 310. One or more refill ports 322 in the sidewall of the outer mandrel 310 are configured to allow fluid to enter, which typically flows through a hollow central section of the inner mandrel 320 when the downhole reservoir stimulating tool 300 is being moved in the wellbore.

Figure 3:
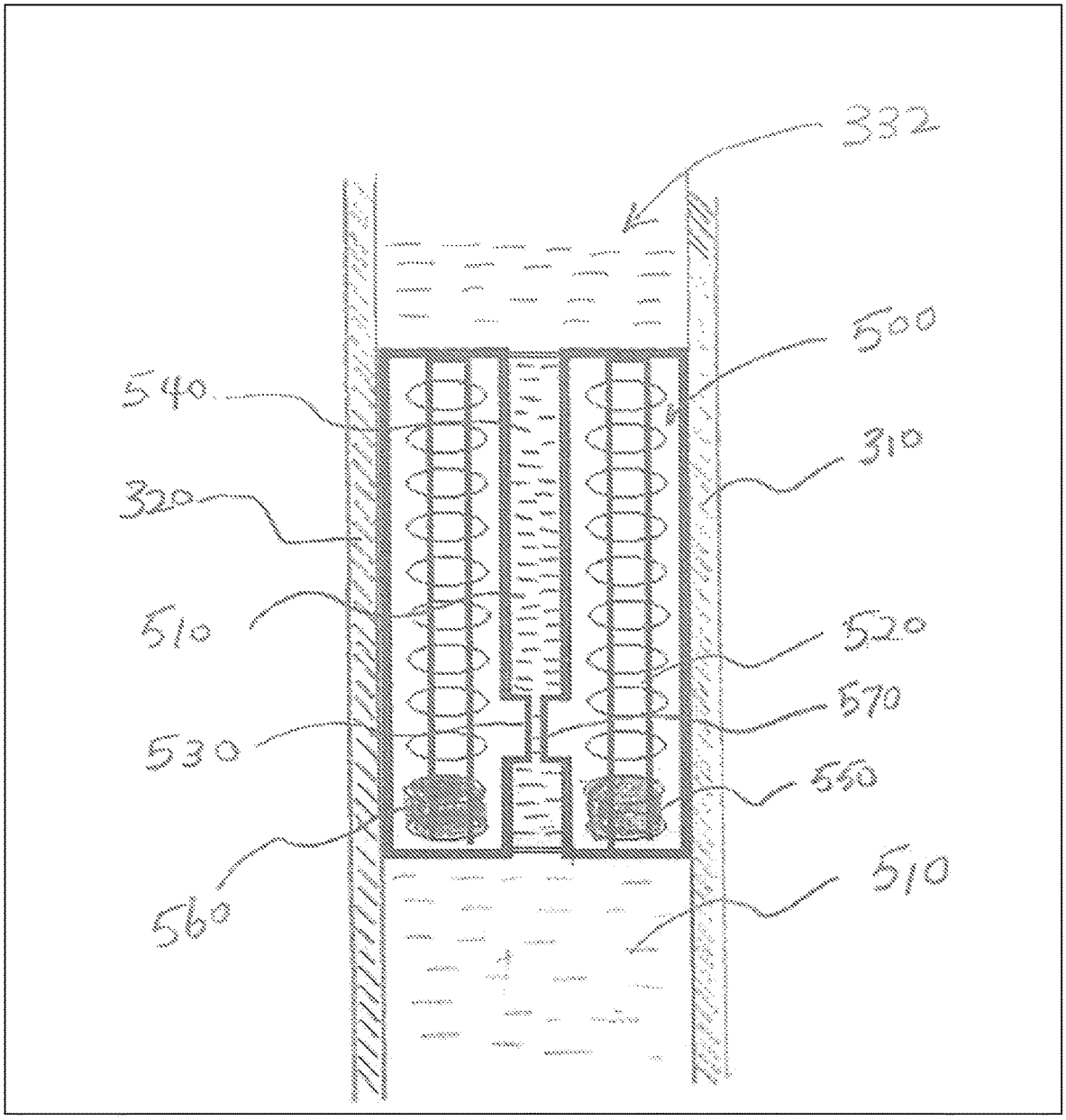
FIG. 3 shows a cross-sectional view of an electromagnetic flowmeter, a component of the downhole reservoir stimulating tool by embodiments of the present disclosure.

Referring now to FIG. 3, a cross-sectional view of the electromagnetic flowmeter 500 is shown in accordance with embodiments of the present disclosure. The electromagnetic flowmeter 500, in certain embodiments, will contain a magnetorheological fluid 510, a chamber containing an electromagnetic coil 520, a power source 550, and a controlling switch 560 that may be activated by the compressional strain energy experienced on the inner mandrel 320. The fluid electromagnetic flowmeter 500 is configured with a fluid conduit 540 that runs through the tool tapering in diameter to a sized flowmeter orifice 570 and then tapering back to its original diameter.

Referring to FIG. 2A, accordingly, during operation, the drill string 200 is lowered until the downhole reservoir stimulating tool reaches a locking ring 316 installed inside the casing string 20. The locking mechanism 314 configured to the outer housing 310 is locked into the locking ring 316 on the casing 20. In one embodiment this may be accomplished by rotating the drill string 200, in another embodiment this may be accomplished through stacking weight on the locking ring 316. One skilled in the art will understand the appropriate location and use of these locking mechanisms.

Referring still to FIG. 2A, accordingly, during the operation once the downhole reservoir stimulating tool 300 is locked into place at the casing locking ring 316, it is restricted from moving up or down. In this position, most of the magnetorheological fluid 510 is contained in the fluid chamber 332 below the electromagnetic flowmeter 500.

Referring now to FIG. 2A, accordingly during the operations, to activate the downhole reservoir stimulating tool, the drill string 200 is picked up slowly causing the inner mandrel of the downhole reservoir stimulating tool 320 to start moving upward relative to the outer mandrel 310.

Figure 2B:
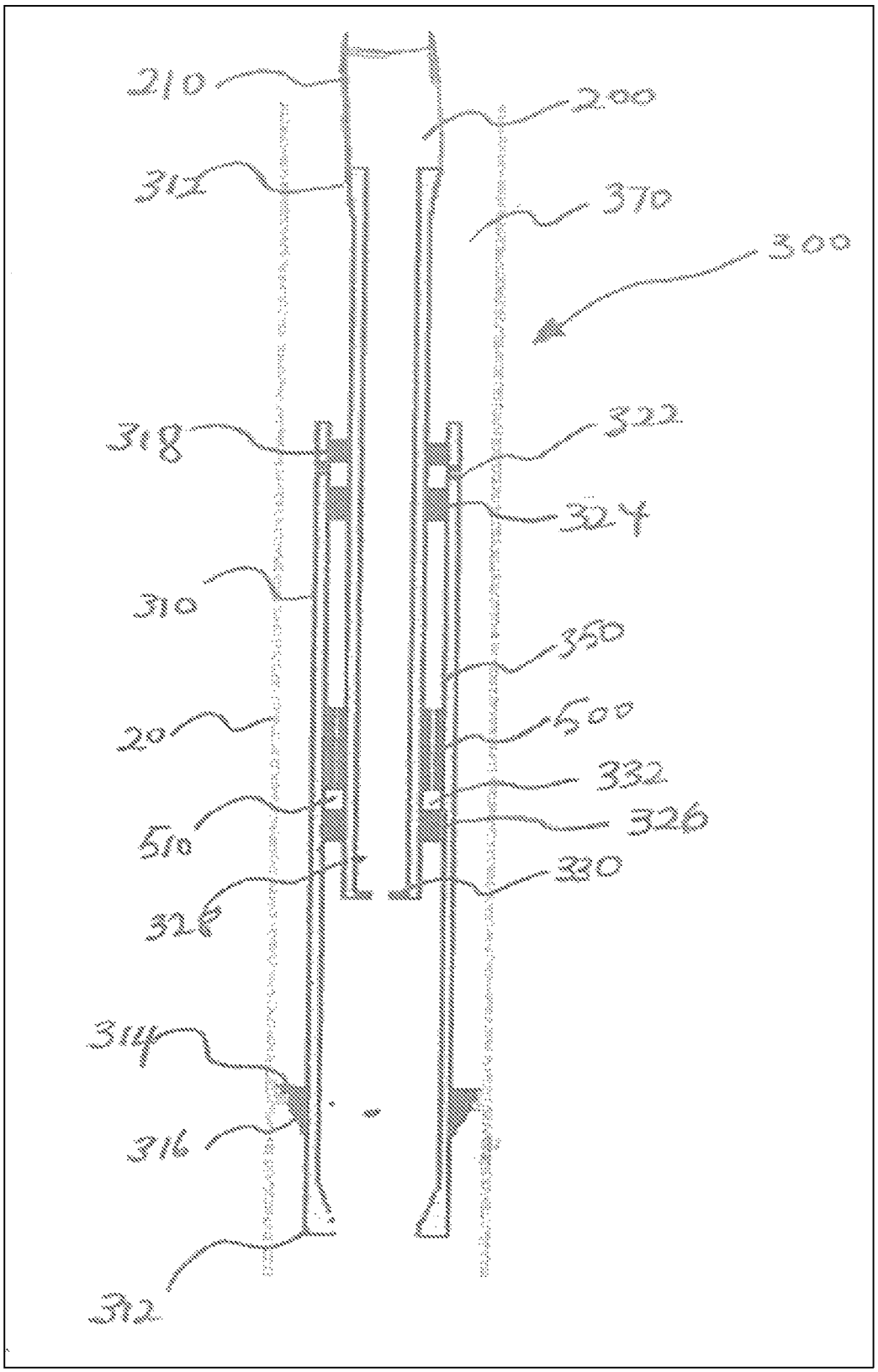
FIG. 2B shows a cross-sectional view of a downhole reservoir stimulating tool in an open position, a component of the downhole reservoir stimulating system by embodiments of the present disclosure.

Referring now to FIG. 1 and FIG. 2B, accordingly, during the operation the upward motion of the drill string 200 results in the downhole reservoir stimulating tool 300 becoming distended. The upward motion causes the lower traveling seal 326 and upper traveling seal 324 to move upward relative to the electromagnetic flowmeter 500.

Referring now to FIG. 2B and FIG. 3, the upper traveling seal 324 and the lower traveling seal 326 seals move up, the magnetorheological fluid 510 contained in the fluid chamber 332 is pushed through the fluid conduit 540 of the electromagnetic flowmeter 500 into the upper fluid chamber. The upward motion of the drill string 200 and subsequently the inner mandrel 320 causes the inner mandrel to go into tension causing the control switch 560 in the electromagnetic flowmeter 500 to be turned off subsequently deactivating the electromagnetic flowmeter 500.

The deactivated electromagnetic flowmeter 500 causes the viscosity of the magnetorheological fluid 510 in the electromagnetic flowmeter 500 to remain unchanged. The original viscosity of the magnetorheological fluid 510 is configured such that it allows the magnetorheological fluid 510 to readily flow across the flowmeter orifice 570 into the upper part of the fluid chamber 332 above the electromagnetic flowmeter 500.

Referring now to FIG. 1, and FIG. 5, the downward motion of the drill string 200 results in the compression tool 700 going into compression. The motion causes the outer mandrel 710 to move down enveloping the lower mandrel 720, compressing the fluid and or spring inside the compression tube 730.

Referring now to FIG. 1, FIG. 2A, and FIG. 3, the downward motion of the drill string 200 results in the downhole reservoir stimulating tool moving down lowering the inner mandrel 320 into the outer housing 310. The downward motion of the drill string 200 and subsequently the inner mandrel 320 causes the inner mandrel to go into compression causing the control switch 560 in the electromagnetic flowmeter 500 to be turned on subsequently activating the electromagnetic flowmeter 500.

The activated electromagnetic flowmeter 500 causes the viscosity of the magnetorheological fluid 510 in the electromagnetic flowmeter 500 to rapidly increase. The high viscosity of the magnetorheological fluid 510 is configured such that it restricts the magnetorheological fluid 510 from flowing across the flowmeter orifice 570 into the lower part of the fluid chamber 332 above the electromagnetic flowmeter 500.

The restriction of the magnetorheological fluid 510 temporarily stops the inner mandrel 320 from moving down into the outer housing 310 which results in the drilling tubulars 210 in the drill string 200 above the downhole reservoir stimulating tool 500 tool to go into compression.

Referring now to FIG. 3, the electromagnetic flowmeter 500 is configured to be deactivated when a pre-set threshold compressional strain is experienced by the inner mandrel 320 allowing the fluid viscosity of the magnetorheological fluid 510 inside the electromagnetic flowmeter 500 to immediately decrease and consequently start flowing rapidly across the flowmeter orifice 570 into the fluid chamber 332 below the electromagnetic flowmeter 500.

Referring now to FIG. 2A, the inner mandrel 320 is configured to travel rapidly down the outer housing 310 once the restriction of the flow of magnetorheological fluid 510 to the fluid chamber is removed. The inner mandrel 320 moves rapidly downward, due to the expansion of the compressed drill string tubulars, the expansion of the inner mandrel inside the compression tube 700, and the momentum of tubulars 210 located in the drill string 200 above the downhole reservoir stimulating tool 300.

The inner mandrel 320 is configured to travel down at a high velocity pushing the upper traveling seal 324, the lower traveling seal 326 and the inner mandrel piston 330.

Referring still to FIG. 2A, the rapid downward movement of the lower traveling seal 326 and the inner mandrel piston 330 results in the fluid resident in the inside of the outer housing 310 below the inner mandrel piston 330 to rapidly increase in pressure consequently creating a high-pressure fluid wave that is propagated through the drill string below the tool towards the injector tool 400.

Referring to FIG. 4, the injector tool 400 is configured to manage and further propagate the high-pressure fluid that is being propagated from the downhole reservoir stimulating tool 300 to the surface of the subsurface formation 30 where it may cause the subsurface formation 30 to fracture. Consequently, this may result in fluid flowing outward from the injector tool 400, through the injector nozzle 420, and into the subsurface formation 30.

The operational process used to energize and activate the downhole reservoir stimulating tool 300, as described in sections to section can be repeated multiple times. One skilled in the art of drilling will understand the appropriate operations necessary required to re-energize and activate the tool by moving the drill string up and down using the rig apparatus.

As depicted, in FIG. 2A the outer housing 310 is configured to protect and contain components (i.e., electromagnetic flowmeter 500, inner mandrel 320, etc.) of the downhole reservoir stimulating tool 300. Furthermore, the housing 310 may also include at least one annular port 322 that provides a path for the fluid in the annulus 370 between the casing 20 and the drill string 200 to enter the downhole reservoir stimulating tool 300.

In another embodiment, the injector tool 400 is configured to contain components such as check valves that are actuated by the high-pressure fluid wave and caused to impact the subsurface formation to create fractures.

In another embodiment, the injector tool 400 may include no specialized nozzles configured into the apertures.

In another embodiment, the injector tool 400 may include a piston configured to modify the volume and energy of the high-pressure pressure wave propagated in the drill string 200.

In another embodiment, the electromagnetic flowmeter 500, may be replaced with a spring-activated mechanism that is capable of temporarily restricting the inner mandrel 320 from moving down into the outer housing 310.

In this present embodiment, the drill string and wellbore are filled with fracking fluid. In other embodiments, the lower sections of the drill string and wellbore may be filled with fracking fluid, and the upper sections of the drill string and wellbore filled with a drilling fluid not containing proppants and chemicals typically used in fracking fluid.

In another embodiment, the downhole reservoir stimulating system 100 may be configured so that the drill string 200 accommodates more than one downhole reservoir stimulating tool 300, allowing the downhole reservoir stimulating system 100 to create multiple high-pressure fluid waves each time the system is activated.

In another embodiment, the downhole reservoir stimulating system 100 may be configured so that the drill string 200 accommodates more than one compression tool 700, allowing the downhole reservoir stimulating system 100 to have a greater length when in tension.

Embodiments disclosed herein may include combinations of any and/or all of the features described that are configured to induce fractures in the subsurface formation 30. Those skilled in the art will understand various combinations of all of the features described herein.

As known by one skilled in the art of drilling, varying the stacking weight of the drilling tubulars above the downhole reservoir stimulating tool 300, will vary the velocity of the inner mandrel piston 328 when the downhole reservoir stimulating tool 300 is activated, subsequently varying the amplitude and frequency of the propagated pressure fluid wave and consequently the force and rate of impact on the subsurface formation 30.

Advantageously, embodiments of the present disclosure may increase permeability through the intermittent fracking of pressure waves produced by the downhole reservoir stimulating tool 300 at the subsurface formation 30 resulting in a significant fracture network in close proximity to the casing 20.

Additionally, embodiments of the present disclosure provide a downhole reservoir stimulating system that provides an apparatus and method that can be utilized to fracture a subsurface formation; that requires very low fluid volumes, significantly reducing the volume of water required to fracture the subsurface formation using traditional hydraulic fracking practices; that utilizes energy from downhole, reducing the emissions of $CO_2$ as opposed to utilizing large pump trucks for traditional fracking; and that produces very little toxic flowback fluid to the surface.

While the present disclosure has been described with respect to a limited number of embodiments, those skilled in the art, having the benefit of this disclosure, will appreciate that other embodiments may be devised which do not depart from the scope of the disclosure as described herein. Accordingly, the scope of the disclosure should be limited only by the attached claims.

What is claimed:

1. A downhole reservoir stimulating tool to be run on a drill string, the tool comprising:

an outer housing, an inner mandrel disposed within the outer housing and configured to move parallel relative to the outer housing, an electromagnetic flowmeter disposed within the outer housing and configured to temporarily restrict downward movement of the inner mandrel, resulting in compressional strain energy derived from compressing drill string tubulars of the drill string above the tool, and an inner mandrel piston coupled to the inner mandrel, configured to convert the compressional strain energy of the drill string tubulars into a high-pressure fluid wave that propagates down the drill string and further propagated into the subsurface formation causing cracks and fractures, enhancing the permeability of the subsurface formation and consequently the production of fluids.

2. The downhole reservoir stimulating tool of claim 1, wherein the drill string works together with the downhole reservoir stimulating tool to transfer the compressional strain energy stored in the compressed drill string tubulars above the tool into the high-pressure fluid wave.

3. The downhole reservoir stimulating tool of claim 1, wherein the tool comprises an electromagnetic flowmeter configured with a magnetorheological fluid that changes viscosity when exposed to an electromagnetic field to temporarily restrict the inner mandrel from moving down into the outer housing of the tool.

4. A method of controlling and varying a hydraulic force impacting a subsurface formation using the downhole reservoir stimulating tool of claim 1, comprising:

varying a time duration for which the inner mandrel is restricted and adjusting a stacking weight applied to the drill string tubulars above the tool for developing intermittent high-pressure fluid waves and subsequently a more concentrated cluster of fractures in the subsurface formation.

5. A method for creating and or stimulating fractures within a sub-surface formation, the method comprising:

positioning a downhole reservoir stimulating tool, as described in claim 1, within a wellbore; anchoring the tool to a wellbore casing;

activating the tool by lifting the inner mandrel within the tool to compress the drill string tubulars above the tool, thereby creating compressional strain energy;

releasing the compressional strain energy to generate high-pressure fluid waves; and propagating the high-pressure fluid waves into the subsurface formation to create and or stimulate fractures.

6. The downhole stimulating tool of claim 1, wherein the tool comprises more than one downhole reservoir stimulating tool, configured in tandem on the drill string, each tool capable of creating several high-pressure waves;

wherein the high-pressure waves can be propagated along the drill string to positively reinforce each other, subsequently increasing a hydraulic force impacting the subsurface formation.

7. A method of creating fractures or stimulating existing fractures in a subsurface reservoir, the method comprising:

running a downhole reservoir stimulating tool into a wellbore on a drill string, the drill string comprising a plurality of drill string tubulars, anchoring the downhole reservoir stimulating tool to a wellbore casing, activating the downhole reservoir stimulating tool by lifting an inner mandrel within the tool to compress the drill string tubulars above the tool and create compressional strain energy, converting the compressional strain energy into high-pressure fluid waves using a release mechanism, and propagating the high-pressure fluid waves into the subsurface formation to create or stimulate fractures.

* * * * *